United States Patent [19]

Giorgini et al.

[11] 4,345,592

[45] Aug. 24, 1982

[54] PRESSURE DEMAND REGULATOR WITH AUTOMATIC SHUT-OFF

[75] Inventors: Eugene A. Giorgini, Cheektowaga, N.Y.; John L. Sullivan, Fort Erie, Canada

[73] Assignee: A-T-O Inc., Willoughby, Ohio

[21] Appl. No.: 185,894

[22] Filed: Sep. 10, 1980

[51] Int. Cl.[3] ..... A62B 7/04

[52] U.S. Cl. ..... 128/204.26; 128/205.24; 137/498; 137/DIG. 9; 137/462

[58] Field of Search ..... 128/204.26, 204.27, 128/205.24; 137/460, 462, 494, 498, DIG. 9

[56] References Cited

U.S. PATENT DOCUMENTS

| | | | |
|---|---|---|---|
| 374,485 | 12/1887 | McGann | 137/462 |
| 2,406,888 | 9/1946 | Meidenbauer, Jr. | 128/204.26 |
| 2,699,799 | 1/1955 | Wager | 137/498 |
| 2,970,602 | 2/1961 | Cupp | 137/DIG. 9 |
| 3,122,162 | 2/1964 | Sands | 137/498 |
| 3,189,027 | 6/1965 | Bartlett, Jr. | 128/205.24 |
| 3,724,482 | 4/1973 | Ekstrom | 128/204.26 |
| 3,756,272 | 9/1973 | Hammond | 137/498 |
| 4,049,016 | 9/1977 | Henry | 137/498 |
| 4,140,112 | 2/1979 | Kobzan | 128/204.26 |
| 4,188,971 | 2/1980 | Otteson | 137/462 |
| 4,274,404 | 6/1981 | Molzan et al. | 128/204.26 |

FOREIGN PATENT DOCUMENTS

| | | | |
|---|---|---|---|
| 2406307 | 8/1975 | Fed. Rep. of Germany | 128/204.26 |
| 1401613 | 7/1975 | United Kingdom | 128/204.26 |
| 2025774 | 1/1980 | United Kingdom | 128/204.26 |

*Primary Examiner*—Henry J. Recla

*Attorney, Agent, or Firm*—Christel, Bean & Linihan

[57] ABSTRACT

A pressure demand breathing apparatus having a face-mask connected through a pressure demand regulator with a shut-off device that operates automatically to interrupt the supply of air to the mask when the face-mask is removed. The device operates with a time delay to permit momentary user-induced high flow rates without interrupting the supply.

7 Claims, 8 Drawing Figures

Fig. 1.
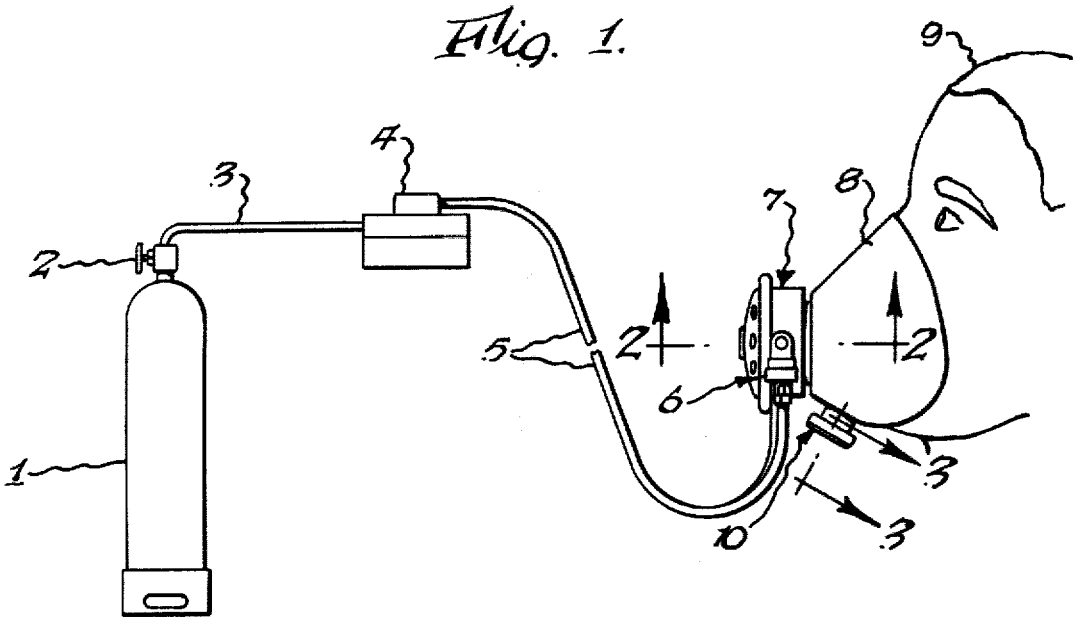
Fig. 2.
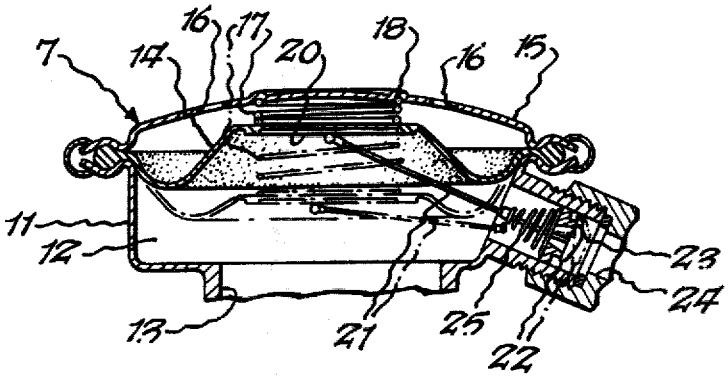
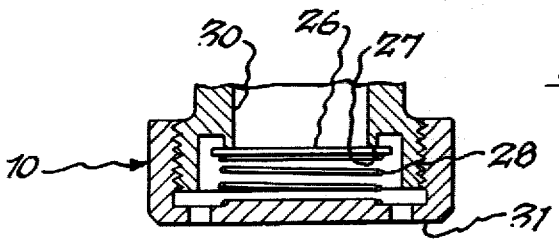
Fig. 3.

Fig. 4.
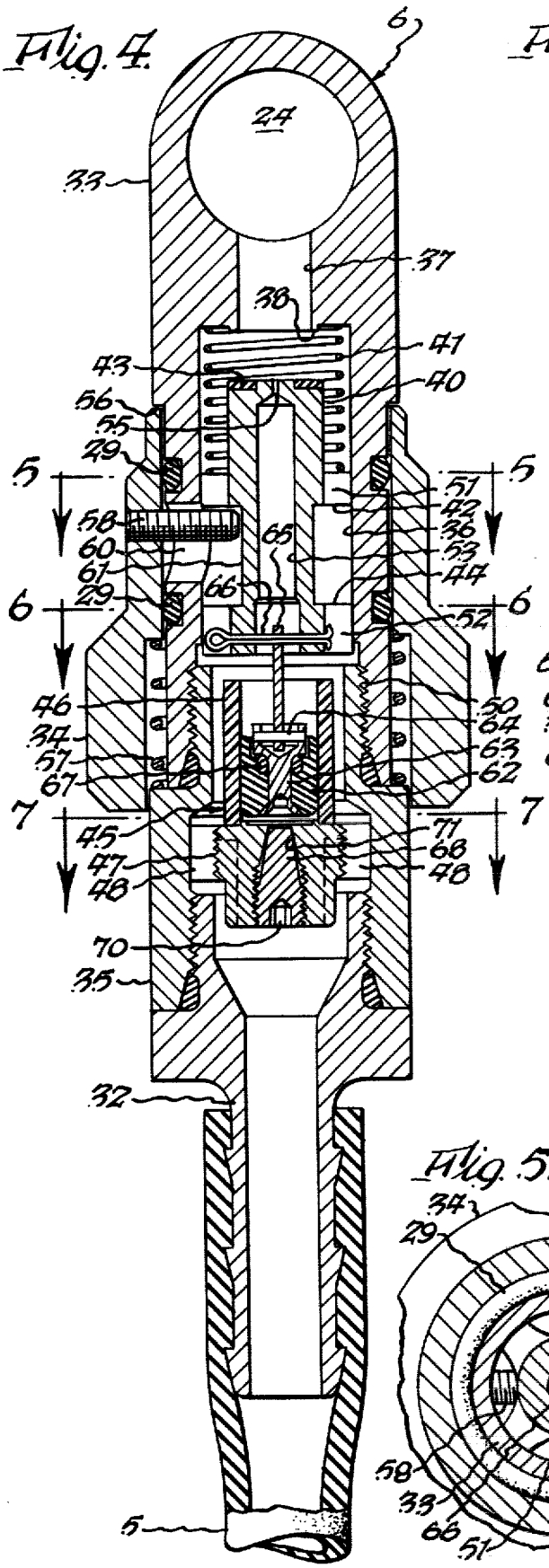
Fig. 8.
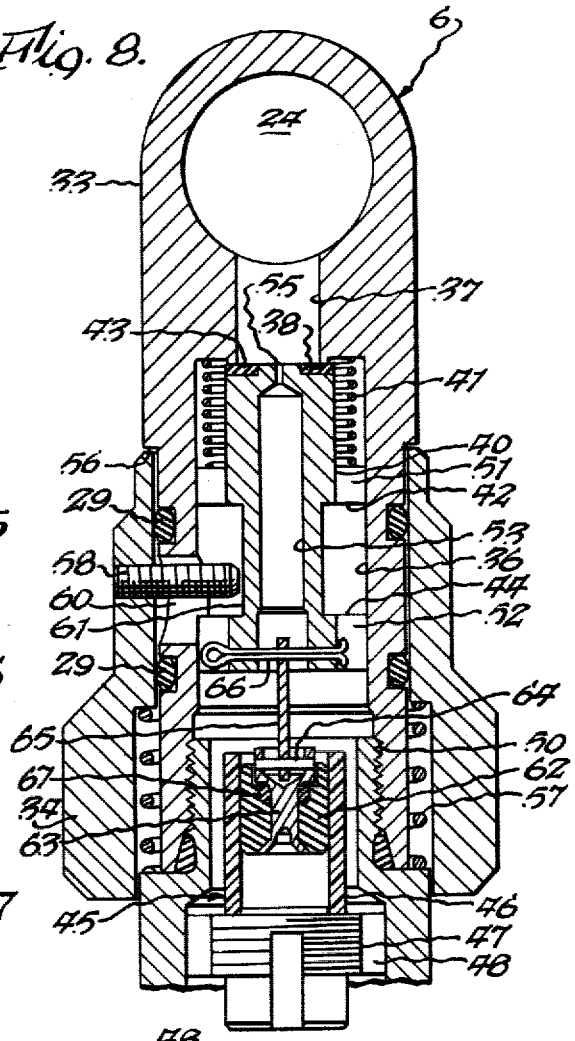
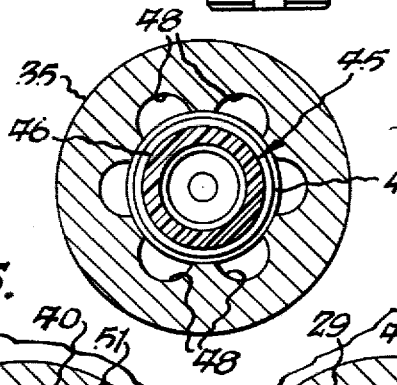
Fig. 7.
Fig. 5.
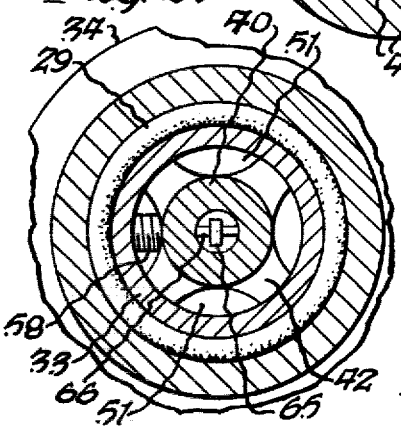
Fig. 6.
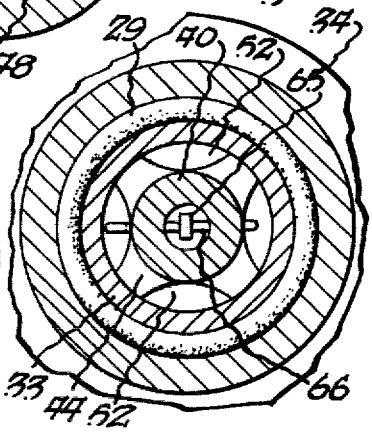

PRESSURE DEMAND REGULATOR WITH AUTOMATIC SHUT-OFF

BACKGROUND OF THE INVENTION

This invention relates to protective breathing apparatus of the type in which a user wears a face mask, sometimes referred to as a respiratory inlet covering, communicating with a source of air or other breathing fluid for use in toxic or oxygen deficient surroundings. More specifically, this invention is directed to such apparatus of the pressure demand type, in which the breathing fluid is provided on demand, and is maintained within the mask at a positive pressure, that is a pressure above atmospheric whereby any leakage caused by poor fit or component failure will be outwardly from the mask, to prevent inflow and possible inhalation of a toxic ambient atmosphere.

However, a problem arises whenever the mask of such pressure demand apparatus is not in place on the face of the wearer, unless the air supply has been manually shut-off. This is because the face of the wearer is required to define the mask chamber within which the positive pressure is to be maintained. If the air supply is not manually shut off, and the mask is off the face and open to the atmosphere, the mask chamber becomes infinitely large and the apparatus cannot maintain a pressure above atmospheric pressure within that chamber. However, the apparatus seeks to do so and the air supply is quickly depleted.

It is known to provide pressure-demand systems which means for manually switching to a straight demand mode. If this is done, the user must remember to switch back to the pressure-demand mode for maximum protection.

The evolution of user and buyer requirements as well as those of various regulatory agencies has seen an upward spiral of flow requirements such that modern regulators, in fully open position, can discharge enormous quantities of air as compared to the normal breathing requirements of a man. Over 500 liters per minute (17.6 cfm) is not unusual as a free flow regulator performance although the minimum approved quantity is 200 liters per minute. During donning and doffing or inadvertant removal of the mask the high flow will occur unless the air supply is off. It is difficult to don or doff and simultaneously turn the air on or off, and if the mask is forced off the wearer's face, for example during a fall, he may not be in a condition to immediately refit the mask or manually shut off the air supply. It is therefore desirable to provide an automatic shut-off of the air supply in such situations where mask back pressure is lacking to prevent escape and rapid wasteful depletion of the limited air supply.

In pending United States patent application Ser. No. 926,004, filed July 19, 1978 in the name of John L. Sullivan, one of the inventors herein, there is disclosed a pressure demand breathing apparatus having an air shut off operable automatically under abnormal flow conditions which occur when the mask is off the face of the user, to interrupt the flow of air to the mask and thereby conserve the air supply. The shut off device is designed to remain open during air flow at rates up to a predetermined rate selected as the maximum flow rate expected to be encountered under normal conditions of use, and to close at flow rates exceeding that preselected rate which are produced when the mask is not in place.

Occasionally a particular user, operating under conditions of extreme stress, requires flow rates momentarily peaking above the preselected rate. It is desirable that the automatic shut off device accommodate such user induced excess flow rates to avoid interrupting the air supply to such a user.

SUMMARY OF THE INVENTION

The primary object of this invention is to provide a pressure demand breathing apparatus having an automatic shut off, and capable of differentiating between normal and abnormal flow conditions, and also between abnormal flow conditions which are user inspired and those which result from a free flow condition.

In one form, the apparatus of this invention is characterized by the provision of a pressure demand regulator, a shut off device responsive to the rate and duration of flow of air to the regulator and operable to close when the flow exceeds a preselected rate and duration, the shut off device including a time delay to accommodate momentary excess flow rates of short duration while permitting the shut off device to close whenever the excess flow rate is of a sustained nature such as would otherwise waste the air supply.

The foregoing and other objects, advantages and characterizing features of this invention will become clearly apparent from the following detailed description of an illustrative embodiment, taken in conjunction with the accompanying drawings wherein like reference numerals denote like parts throughout the various views.

DESCRIPTION OF THE DRAWINGS

FIG. 1 is a somewhat schematic representation of a breathing apparatus according to this invention, the supply line being broken away to indicate indeterminate length;

FIG. 2 is a sectional view of the pressure demand regulator component of the apparatus, taken along line 2—2 of FIG. 1, the regulator valve being shown in closed position with its full open position indicated in phantom;

FIG. 3 is a fragmentary sectional view of the exhalation valve, taken along line 3—3 of FIG. 1;

FIG. 4 is a longitudinal sectional view of the automatic shut-off valve component of the apparatus, showing the same in open position;

FIGS. 5, 6 and 7 are transverse sectional views thereof, taken along lines 5—5, 6—6 and 7—7, respectively of FIG. 4; and FIG. 8 is a fragmentary longitudinal sectional view like that of FIG. 4, but showing the shut-off valve in closed position, shutting off the supply of air to the regulator and mask.

DETAILED DESCRIPTION OF THE ILLUSTRATED EMBODIMENT

Looking first at FIG. 1, there is shown a supply source of air or other breathing fluid under pressure in the form of tank 1 having a manually operable shut-off valve 2. A high pressure air line 3 leads from tank 1 to a first stage regulator 4 which reduces the high pressure air to an intermediate level, typically 100–150 psig. An intermediate pressure air line 5 leads from regulator 4 to an automatic shut-off device, generally designated 6, which is mounted on and communicates with the inlet side of a pressure demand regulator generally designated 7. However, the shutoff device 6, sometimes known as a pneumatic fuse or excess flow valve, also can be located at the discharge side of regulator 4 or at any point in supply line 5 between regulators 4 and 7.

Regulator 7 is mounted on a face mask 8. An exhalation valve, generally designated 10, also is mounted on mask 8. Face mask 8 is contoured to fit against the face 9 of a wearer, shown in outline, being secured in position against the face by a suitble harness or strap arrangement, not shown, such masks and harnesses being well known in the art. When fitted against the face of a wearer, mask 8 provides a mask chamber which is defined by the mask body and by that portion of the wearer's face which is covered by the mask. Regulator 7 is designed to maintain a positive pressure within the mask and regulator chambers, so that in the event of leakage flow will be outward and not into the mask, thereby protecting the wearer from the ambient atmosphere.

Looking now at FIG. 2, there is shown a pressure demand regulator which can be of conventional construction, the illustrated regulator including a body or casing 11 enclosing a regulator chamber 12 which communicates with the mask chamber through a passage 13. Chamber 12 is defined in part by a flexible diaphragm 14 which is clamped between body 11 and a cover 15 having a series of openings 16 therethrough so that the side of diaphragm 15 opposite chamber 12 is open to ambient atmosphere.

To maintain a chamber pressure above atmospheric, diaphragm 14 is biased inwardly of chamber 12 by a spring 17 seated in an annular recess 18 in regulator cover 15 and bearing against the reinforced central portion 20 of diaphragm 14. A tilt valve stem 21 has its outer end bearing against the diaphragm central portion 20 on the side opposite spring 17, and at its opposite end carries a valve body 22 engaging a valve seat 23 to interrupt the flow of air from passage 24 into chamber 12. A centering spring 25 biases stem 21 to a valve closed position.

The pressure within regulator chamber 12 is the same as the pressure within the mask chamber. Whenever the pressure within chamber 12 drops below the positive pressure desired to be maintained, which occurs upon inhalation by the wearer, spring 17 moves diaphragm inwardly, tilting stem 21 and valve body 22 to an open position admitting air at intermediate pressure into chamber 12 and through passage 13 to the mask chamber. When the mask and regulator chambers are at the desired positive pressure, above atmospheric pressure, the biasing action of spring 17 is offset by the air pressure within the chambers and tilt valve 22 is permitted to close. Such regulators are well known in the regulator art and require no further description.

Exhalation valve 10 is a check valve, opening for outward air flow during exhalation, and closing to prevent inflow through the valve during inhalation. Looking at FIG. 3, valve 10 includes a floating disc 26 lightly biased against valve seat 27 by a valve spring 28 with sufficient force to overcome the positive pressure for which regulator 7 is preset by spring 17 and hold disc 26 against seat 27. A passage 30 communicates with the mask chamber, and during exhalation the additional pressure within the mask chamber caused by the exhalation effort moves disc 26 against spring 28 away from seat 27 for exhalation through passage 30 to atmosphere. An apertured cover 31 is threaded on the body of valve 10 to hold spring 28 and disc 26 in place, and also to adjust the closing bias force on disc 26 by varying the compression of spring 28. This permits selective adjustment of the pressure required to open exhalation valve 10 to a level greater than the positive pressure being maintained within the mask chamber by spring 17.

When the pressure in the mask and regulator chambers drops below the predetermined positive pressure set to be maintained by regulator 7, diaphragm 14 is moved inwardly by spring 17, causing valve 22 to open. This creates a serious problem if the mask is removed from the face, because upon such removal the mask chamber is opened to atmosphere, also opening regulator chamber 12 to atmosphere and making it impossible to maintain the selected positive (i.e. above-atmospheric) pressure in chamber 12. Spring 17 will move diaphragm 14 and tilt valve 22 to a wide open, full flow position with the result that a substantial quantity of air will be lost, and if permitted to continue, the air supply will be quickly depleted. This can occur, for example if mask 8 is knocked from the face of a fireman during a fall and he is unconscious and unable to manually turn off the air supply. However, with the apparatus of this invention, such abnormal flow conditions are sensed and the supply of air is shut off automatically.

Turning now to FIGS. 4–8, showing the automatic shut off device 6 in detail, a suitable hose fitting 32 connects air line 5 to shut-off 6, and continues the air passageway from line 5 into the shut-off device. Passage 24 at the upper portion of the device as illustrated in FIGS. 4 and 8 leads directly into regulator 7, as shown in FIG. 2.

Shut-off device 6 includes a body 33 on which a reset sleeve 34 is slidable as hereafter described. A damper retaining body 35 is threaded into the end of body 33 opposite passage 24, and at its opposite end is threaded onto hose fitting 32, O-ring seals being provided between bodies 33 and 35, and between body 35 and fitting 32, as clearly shown in FIG. 4. Body 33 has a generally cylindrical passage or bore 36 which is open to the source and which leads to a smaller diameter passage 37 surrounded by a valve seat 38 and communicating with the passage 24 leading to regulator 7. A poppet valve 40 is axially movable in passage 36 between the wide open position shown in FIG. 4 and the seated, closed position shown in FIG. 8. A compression spring 41 disposed between a radially projecting flange 42 on poppet 40 and the end wall of valve body 33 around seat 38 biases poppet 40 away from seat 38 to its normally open position shown in FIG. 4. On its end facing seat 38 poppet 40 carries an annular washer 43 of a suitable resilient material for engaging seat 38 to close the air passage around poppet 40.

At its end opposite seat 38, poppet 40 is formed with a second radially projecting flange 44 and is connected to a damper assembly in the form of a dashpot generally designated 45. Damper 45 includes a hollow cylindrical sleeve 46 of glass or other suitable material, mounted on a member 47 which is threaded into body 35 as shown in FIGS. 4 and 7, the body 35 being formed to provide a multiplicity of air passages 48 spaced around the dashpot mounting member 47. Flanges 42 and 44 on poppet 40 are formed to provide a plurality of air passages 51 and 52 around poppet 40, leaving a plurality of radially extending guide arms between the respective sets of passages as shown in FIGS. 5 and 6. Sleeve 46 is spaced radially inwardly at the end opposite the externally threaded end 50 of damper retaining body 35, thereby providing an air passage from line 5 through hose fitting 32, passages 48, the annular space between sleeve 46 and body portion 50, passages 52 through the guide flange 44 and passages 51 through guide flange 42 and passage 37 to the passageway 24. This flow through shut-off 6 creates a pressure drop across valve poppet 40 and under normal flow conditions that pressure drop is not sufficient to overcome the opening bias of spring 41 and the drag of the damper. However, under sustained high flow conditions a significantly greater pressure drop occurs across the shut-off valve poppet 40, causing it to move against the bias of spring 41 and the drag of the damper to its closed position against seat 38. Once this occurs, the only passage of air permitted through the shut-off device is a small bleed flow through the hollow bore 53 of the poppet spool 40 and the small, central bleed opening 55 through the seating face of the poppet. The upstream air pressure acting against the entire end face area holds the poppet closed, thereby interrupting the supply of air to regulator chamber 12 and mask 8, preventing rapid depletion of the air supply.

Spring 41 and the damper adjustment are selected to permit closing of the poppet 40 only when the sustained flow rate exceeds the rate and time selected as the normal maximum values. A user of the apparatus inhales and exhales in a cyclic pattern so that normal flow through the regulator is also cyclic. Consequently, if the time period for sustained flow is greater than the inhalation/exhalation period of the longest breathing cycle that is anticipated it can be assumed that the facemask has been removed or dislodged from the face of the wearer. A spring 41 having different bias force is used when a different maximum sustained flow rate is selected and the dashpot is adjusted, as hereafter described, when a different time period for sustained flow is selected.

When the mask is refitted on the wearer, the mask chamber is closed by the wearer's face and poppet 40 will reset automatically because of accumulating downstream pressure resulting from the air flowing through bleed orifice 55', passages 37 and 24 into regulator chamber 12. While the poppet will reset automatically, a manual reset also is provided in the form of sleeve 34 which normally is urged against a shoulder 56 on body 33 by a compression spring 57 housed between the enlarged end of sleeve 34, body 33 and damper retaining body 35. Spring 57 is seated on an internal shoulder within sleeve 34 and a shoulder provided by body 35. A set screw 58 is carried by sleeve 34 and extends through an axially elongated opening 60 in the wall of body 33 into the annular, axially elongated groove 61 formed on poppet 40 between flanges 42 and 44. O-rings 29 are positioned between sleeve 34 and body 33 on opposite sides of opening 60. Looking at FIG. 8, showing the valve 40 closed, if sleeve 34 is retracted against the action of its compression spring 57, downwardly away from valve seat 38, screw 58 will engage flange 44 and shift valve poppet 40 away from valve seat 38 to the open position shown in FIG. 4. If desired, bleed passage 55 can be omitted and only a manual reset provided.

To this extent, the operation of this apparatus is like that described in application Ser. No. 926,004 which also functions to interrupt the air supply under abnormal flow conditions, will reset automatically when the mask is in place on the wearer, and can be manually reset.

It is a particular feature of this invention that the automatic shut off component not only differentiates between flow rates above those normally expected to be encountered and for which the spring 41 and damper 45 are preselected, and flow rates below that figure expected to be encountered under normal conditions of use, but also differentiates and distinguishes between flow rates momentarily exceeding the preselected maximum, such as might be produced by a particular user under conditions of extreme stress, and excessive flow rates which are sustained. The condition to be guarded against is the wide open condition occurring when mask 8 is not in place on the face of the wearer and demand regulator 7 is seeking to reestablish the desired positive pressure condition within the regulator chamber 12, which it cannot do because the mask chamber is open to the ambient atmosphere, presenting the system with an undefined, relatively infinite volume to fill with air at a predetermined pressure above atmospheric. The air supply will be quickly depleted in a futile attempt to accomplish this. On the other hand, if the system is set to accommodate, for example, flow rates up to 500 lpm, and even if that is the highest flow rate expected to be encountered under normal conditions of use, it is possible that a particular user operating under high stress conditions may because of his physiology, inspire in a manner producing a flow rate momentarily exceeding the preselected value. Obviously, it would be extremely distressing under those conditions if shut off device 6 were to interrupt the supply of air, just when the user was making this abnormal peak demand. Therefore, it is a particular feature of this invention that shut off device 6 operates automatically to interrupt the supply of air only upon sustained flow at a rate exceeding the preselected value and not in response to a momentary excess flow rate occurring for example over a period of time on the order of a few seconds.

In the illustrated embodiment, that further differentiation is accomplished through the use of dashpot assembly 45 which includes a piston 62 moveable within sleeve 46, the exterior surface of the piston and the inner wall of the sleeve having an extremely close fitting relation providing essentially air tight sliding seal. A stem 63 extends through piston 62, being flared at its opposite ends and carrying a pin 64 providing a pivot connection with a link 65. At its opposite end, link 65 has a pivot connection with a pin 66 carried by the flange end 44 of valve poppet 40. An O-ring 67 between the inner, stepped bore wall of piston 62 and the stem 67 provides an airtight seal.

A needle valve 68 is threaded in the lower end of a central passage through mounting member 47, having a socket 70 for the reception of a tool to adjust the setting of the needle valve by threading it further inwardly and outwardly relative to the tapered end 71 of the passage through the mounting member 47. In this way, the cross sectional area of the annular passage between valve 68 and passage end 71 can be varied, to regulate the rate of flow of air through member 47 into and out of the chamber within sleeve 46 between piston 62 and member 47.

With this construction under abnormal flow conditions of any duration the resulting pressure drop will move valve poppet 40 against compression spring 41, toward its closed position of FIG. 8. However, instead of slamming closed, dashpot 45 will slow down the rate of movement of valve poppet 40 enough to prevent it from seating until a predetermined time has elapsed. That is because as valve poppet 40 moves toward its seated position it pulls piston 62 outwardly within sleeve 46, enlarging and thereby creating a reduced pressure in the chamber behind the piston and producing a hold back force or drag on piston 62 and poppet 40. Needle valve 68 regulates the rate at which air can move into and out of that chamber, thereby providing a damping, dashpot action slowing down the closing movement of the valve poppet 40.

Needle valve 68 is adjusted to insure that the valve poppet does not close until a sufficient time has elapsed to accommodate momentary flow rates which are abnormal in the sense that they exceed the preselected value but which result from an unusual breathing effort. A sustained flow rate above the preselected value and of a duration exceeding the time delay provided by dashpot 45, such as will result when the mask is not in place on the face of the user, causes shut-off device 6 to close, interrupting and thereby conserving the air supply. The time delay provided for this purpose is selectively variable.

Accordingly, it is seen that this invention fully accomplishes its intended objects. While a particular embodiment has been illustrated and described in detail, it will be appreciated that this invention is not intended to be limited thereby, and is intended to be defined by the scope of the appended claims.

What is claimed is:

1. In a pressure-demand breathing apparatus including a face mask providing a mask chamber when fitted against the face of a user, and means including an air supply line for connecting said mask to a pressurized air supply, a pressure demand regulator positioned in said air supply line between said face mask and said air supply, said pressure-demand regulator including means responsive to pressure within said mask chamber for admitting said pressurized air to said mask chamber at flow rates required for normal breathing or abnormally deep breathing when said mask is worn and for maintaining a predetermined positive pressure in the mask chamber above ambient pressure when said mask is fitted against the face of a user, said regulator also admitting said pressurized air to said mask at a predetermined high air flow rate substantially greater than that required either for normal breathing or for abnormally deep breathing when said mask is removed the improvement comprising shut off means for interrupting air flow from said air supply to said mask chamber and time delay means for preventing said shut-off means from interrupting said air flow for a predetermined period of time, wherein said shut-off means is responsive to said air flow and time delay means to interrupt the supply of air to said mask automatically upon sustained high flow through said regulator at a rate exceeding that required even for abnormally deep breathing which occurs for a time exceeding said predetermined period of time, whereby, said shut off means differentiates between temporary, user-induced high flow rates only momentarily exceeding that required even for abnormally deep breathing and sustained high flow rates exceeding said preselected values, such as occur when said mask is removed from the face of a user and open to ambient atmosphere, said shut-off means operating to interrupt the air supply only in the event of such sustained high flow rates.

2. Pressure-demand breathing apparatus as set forth in claim 1, said shut off means having reset means for restoring the air supply to said regulator and mask automatically upon fitting said mask against the face of a user.

3. Pressure-demand breathing apparatus as set forth in claim 1, said shut off means having means for manual resetting to restore the supply of air to said regulator and mask.

4. Pressure-demand breathing apparatus as set forth in claim 1, wherein said shut off means includes a control valve moveable between an open position and a closed position interrupting the air supply to said mask, a compression spring biasing said control valve to its open position, said control valve being moveable to its closed position against the bias of said spring upon an abnormal drop in air pressure on its downstream side, and time delay means retarding the closing action of said control valve thereby accommodating flow rates above said preselected value for a brief time interval.

5. Pressure-demand breathing apparatus as set forth in claim 4, wherein said time delay means includes a dashpot assembly operatively connected to said control valve.

6. Pressure-demand breathing apparatus as set forth in claim 5, together with means for selectively regulating the damping action of said dashpot assembly.

7. Pressure-demand breathing apparatus as set forth in claim 4, together with bleed passage means operable in the closed position of said control valve to admit controlled flow of air to said mask for automatically resetting said control valve upon donning said mask.

* * * * *